US011098516B2

(12) United States Patent
Kaiser

(10) Patent No.: US 11,098,516 B2
(45) Date of Patent: Aug. 24, 2021

(54) DAMPER ASSEMBLY AND FLAP FITTING

(71) Applicant: HETTICH-ONI GMBH & CO. KG, Vlotho (DE)

(72) Inventor: Andre Kaiser, Bielefeld (DE)

(73) Assignee: HETTICH-ONI GMBH & CO. KG, Vlotho (DE)

( * ) Notice: Subject to any disclaimer, the term of this patent is extended or adjusted under 35 U.S.C. 154(b) by 0 days.

(21) Appl. No.: 16/628,140

(22) PCT Filed: Jun. 26, 2018

(86) PCT No.: PCT/EP2018/067153
§ 371 (c)(1),
(2) Date: Jan. 2, 2020

(87) PCT Pub. No.: WO2019/007762
PCT Pub. Date: Jan. 10, 2019

(65) Prior Publication Data

US 2020/0131828 A1 Apr. 30, 2020

(30) Foreign Application Priority Data

Jul. 3, 2017 (DE) ..... 10 2017 114 776.4

(51) Int. Cl.
*E05F 3/18* (2006.01)
*E05F 3/20* (2006.01)

(52) U.S. Cl.
CPC ..... *E05F 3/18* (2013.01); *E05F 3/20* (2013.01); *E05Y 2201/212* (2013.01); *E05Y 2201/604* (2013.01); *E05Y 2900/20* (2013.01)

(58) Field of Classification Search
CPC ..... E05F 3/18; E05F 3/20; E05Y 2201/212; E05Y 2201/604; E05Y 2900/20
See application file for complete search history.

(56) References Cited

U.S. PATENT DOCUMENTS 5,678,844 A * 10/1997 Dassler ..... B60G 15/068 280/124.155
6,456,365 B1 * 9/2002 Hosaka ..... B41J 29/13 347/101

(Continued)

FOREIGN PATENT DOCUMENTS

DE 102011106728 A1 7/2012
EP 2138658 B1 8/2011

(Continued)

OTHER PUBLICATIONS

International Search Report dated Oct. 5, 2018 in related/corresponding International Application No. PCT/EP2018/067153.

(Continued)

*Primary Examiner* — Victor D Batson
*Assistant Examiner* — Matthew J Sullivan
(74) *Attorney, Agent, or Firm* — Patent Portfolio Builders PLLC

(57) ABSTRACT

A damping assembly for a flap fitting includes first and second spring holders, between which at least two coil springs are arranged. In each of the at least two coils springs, a linear damper having a damper housing and having a piston rod slidable relative to the damper housing is arranged between the first and second spring holders.

14 Claims, 14 Drawing Sheets

(56) References Cited

U.S. PATENT DOCUMENTS

| | | | | |
|---|---|---|---|---|
| 7,178,202 | B2 * | 2/2007 | Hirtsiefer | E05F 1/1261 16/366 |
| 7,500,287 | B2 | 3/2009 | Brüstle | |
| 10,253,539 | B2 * | 4/2019 | Kaiser | E05F 1/1276 |
| 10,754,285 | B2 * | 8/2020 | Kondo | G03G 15/605 |
| 2002/0189052 | A1 * | 12/2002 | Melhuish | E05F 1/1276 16/343 |
| 2007/0124893 | A1 * | 6/2007 | Brustle | E05F 1/1075 16/296 |
| 2013/0333291 | A1 * | 12/2013 | Blum | E06B 3/385 49/386 |
| 2020/0308889 | A1 * | 10/2020 | Scheuring | E05F 3/16 |

FOREIGN PATENT DOCUMENTS

| | | | |
|---|---|---|---|
| EP | 2949846 | A1 | 12/2015 |
| WO | 2006005086 | A1 | 1/2006 |
| WO | 2010130372 | A1 | 11/2010 |
| WO | 2012095091 | A1 | 7/2012 |

OTHER PUBLICATIONS

Search Report created on Apr. 27, 2018 in related/corresponding DE Application No. 10 2017 114 776.4.
Written Opinion dated Oct. 5, 2018 in related/corresponding International Application No. PCT/EP2018/067153.

* cited by examiner

DAMPER ASSEMBLY AND FLAP FITTING

BACKGROUND AND SUMMARY OF THE INVENTION

Exemplary embodiments of the present invention relate to a damper assembly, in particular for a flap fitting, comprising a first spring holder and a second spring holder, between which at least two springs are arranged which are designed as coil springs, and a flap fitting, in particular for furniture, comprising a housing that can be fixed to a body, on which a support lever is rotatably mounted, and a pivotably mounted control lever, wherein the support lever and the control lever can be connected in an articulated manner to a flap via spaced rotary shafts, wherein the flap is pretensioned via an energy accumulator at least over part of the range of movement.

EP 2 138 658 B1 discloses a flap fitting for a furniture flap in which the furniture flap is pivoted via an actuating arm and a control lever. The furniture flap is pretensioned in the closing direction by means of a tension spring. In order to lift the furniture flap of such flap fittings, energy accumulators are required which are intended to absorb high forces in a compact design. In addition, the user is often annoyed by loud impact noises.

Accordingly, exemplary embodiments of the present invention are directed to a damper assembly, in particular for a flap fitting, which in a compact design provides high forces for holding and closing a movable component, in particular a furniture part.

In the damper assembly according to the invention, at least two springs in the form of coil springs are provided, in each of which a linear damper with a damper housing and a piston rod displaceable relative to the damper housing are arranged. This means that large pretensioning forces can be exerted on the damper assembly, wherein the dampers prevent high acceleration and cause corresponding braking or damping forces. The springs and dampers can therefore increase the ease of operation, especially with short travel distances, as required for flap fittings, and have a very compact design.

Preferably, the first and second spring holders are designed as dimensionally stable brackets on which the dampers and springs are mounted. At least three springs, for example four springs, are preferably provided in order to generate high pretensioning forces, for example to balance weight forces in a pivotable flap. The springs can be designed as compression or tension springs.

In order to avoid transverse forces caused by the damper assembly, it is preferably formed symmetrical to a central plane with regard to the arrangement of the springs.

In order to avoid loud impact noises, it is preferable to fix the damper housing to the first spring holder and the piston rod to the second spring holder. An elastic stop is arranged between the receptacle and the second spring holder, which can be placed either directly against the spring holder or against a component connected to the spring holder in an end position. The stop can either be fixed to the second spring holder or to the end of the receptacle in order to avoid annoying impact noises.

In a further embodiment, the spring holders are connected to each other by additional linear guide means without dampers, for example a sliding element guided on a rail, which are arranged outside or inside the springs.

To generate different damping forces, the damper housing can have different areas with different diameters in a piston working chamber in which the piston of the damper is linearly displaceable.

In accordance with the invention, a flap fitting with a damper assembly is also provided, wherein the flap fitting has a housing that can be fixed to a body, a rotatable support lever and a pivotably mounted control lever, wherein the support lever and the control lever are connectable in an articulated manner to a flap via spaced rotary shafts. This means that the damper assembly can be used to comfortably design a movement sequence for the flap, especially with regard to closing and opening the flap.

The damper assembly is preferably used to slow down a closing movement of the damper before it reaches the closing position. Preferably, the energy accumulator is used to pretension the flap in a closing position in the closing direction and the flap is pretensioned in an opening range in the opening direction. The user can then overcome a dead center when opening the flap, and after overcoming the dead center, the flap can be moved in the opening direction supported by spring force or automatically. Conversely, after overcoming the dead center, the flap is automatically moved in the closing direction and then braked by the dampers. In a middle position of the flap, which can be before and/or after the dead center position, the flap can also be kept in balance so that it does not independently perform any closing or opening movement in the middle opening range.

In order to be enable precise actuation of the damper assembly, a spring holder is preferably coupled to the control lever via a curve guide. The curve guide can be actuated via a gear unit which is driven by the control lever. Gearwheels, pivot levers or other gear elements can be used as gear units.

BRIEF DESCRIPTION OF THE DRAWING FIGURES

The invention is explained in more detail below using an embodiment example with reference to the attached drawings, wherein.

DETAILED DESCRIPTION

Figure 1:
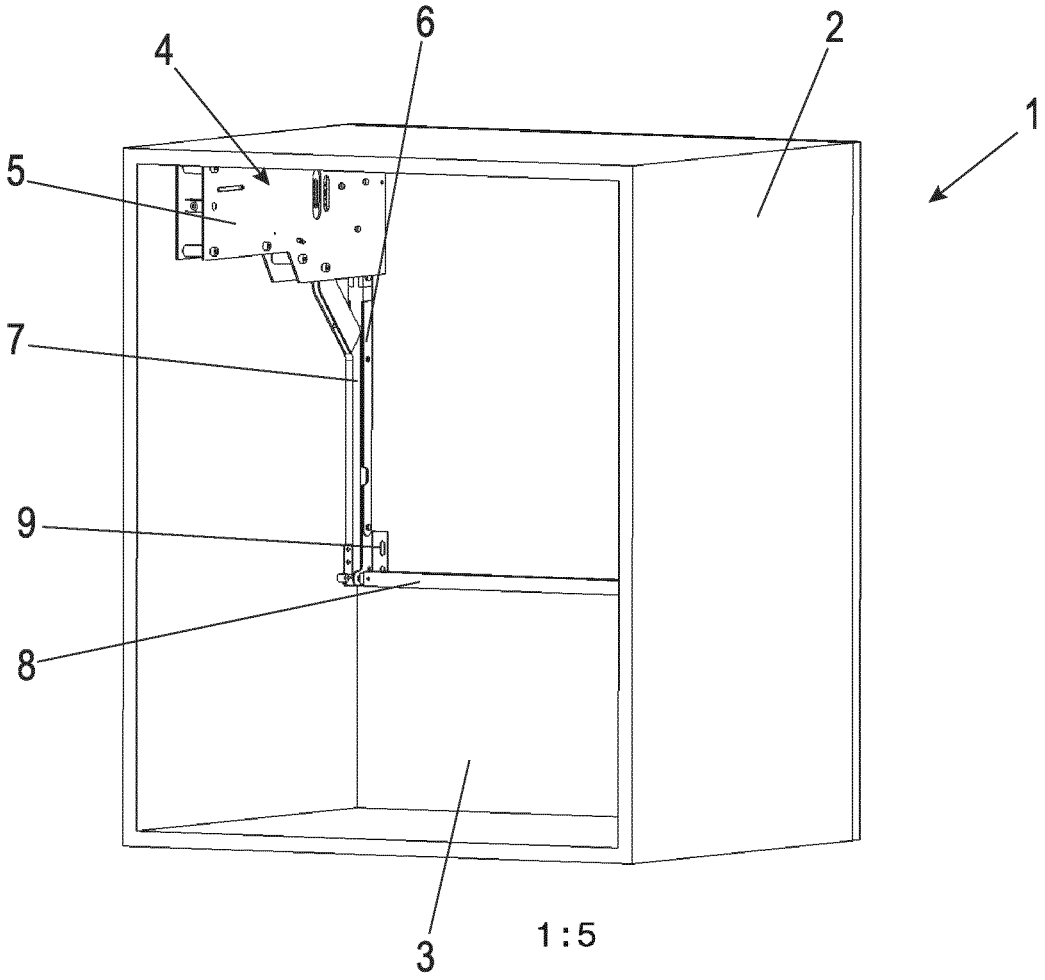
FIG. 1 shows a perspective view of an item of furniture according to the invention with a flap fitting.

An item of furniture 1 comprises a furniture body 2, for example for a wall unit in a kitchen, in which the rear wall has been omitted in FIG. 1. Furniture body 2 is closed at one front by a pivotably mounted flap 3. To guide the flap 3, a flap fitting 4 with a housing 5 is mounted in each case on opposite side walls of the furniture body 2. Each flap fitting 4 comprises a support lever 6 and a control lever 7, which are connected to the flap 3 via a connection 9. The two connections 9 of the opposite flap fittings 4 are synchronized via a rod 8, so that when flap 3 is opened and closed, the flap fittings 4 are essentially moved synchronously.

Figure 2:
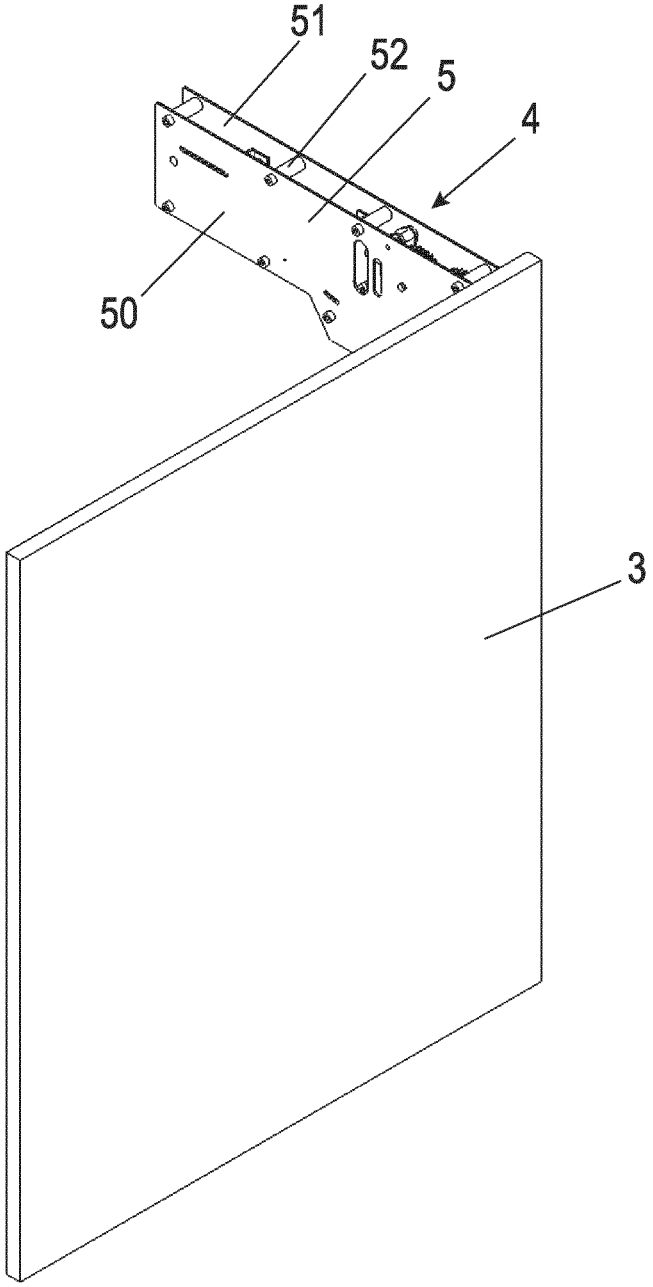
FIG. 2 shows a perspective view of the front panel with a flap fitting.

FIG. 2 shows a flap fitting 4 with flap 3 without furniture body 2. The housing 5 of the flap fitting 4 comprises two side walls 50 and 51, which are arranged at a distance from each other via a large number of spacers 52. Other housing types can also be used for housing 5.

Figure 3A:
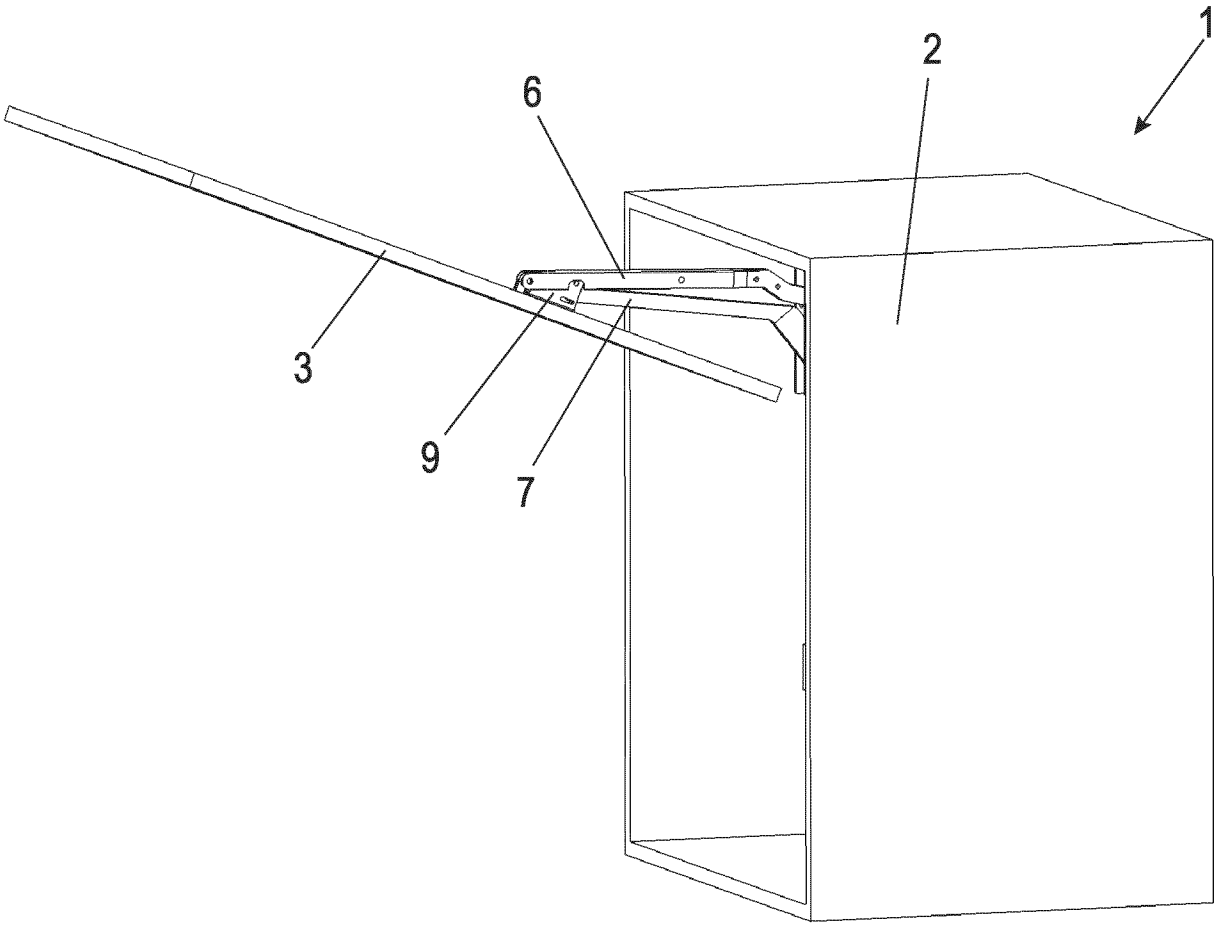
FIGS. 3A and 3B show two views of the item of furniture of FIG. 1 with an open flap.
Figure 3B:
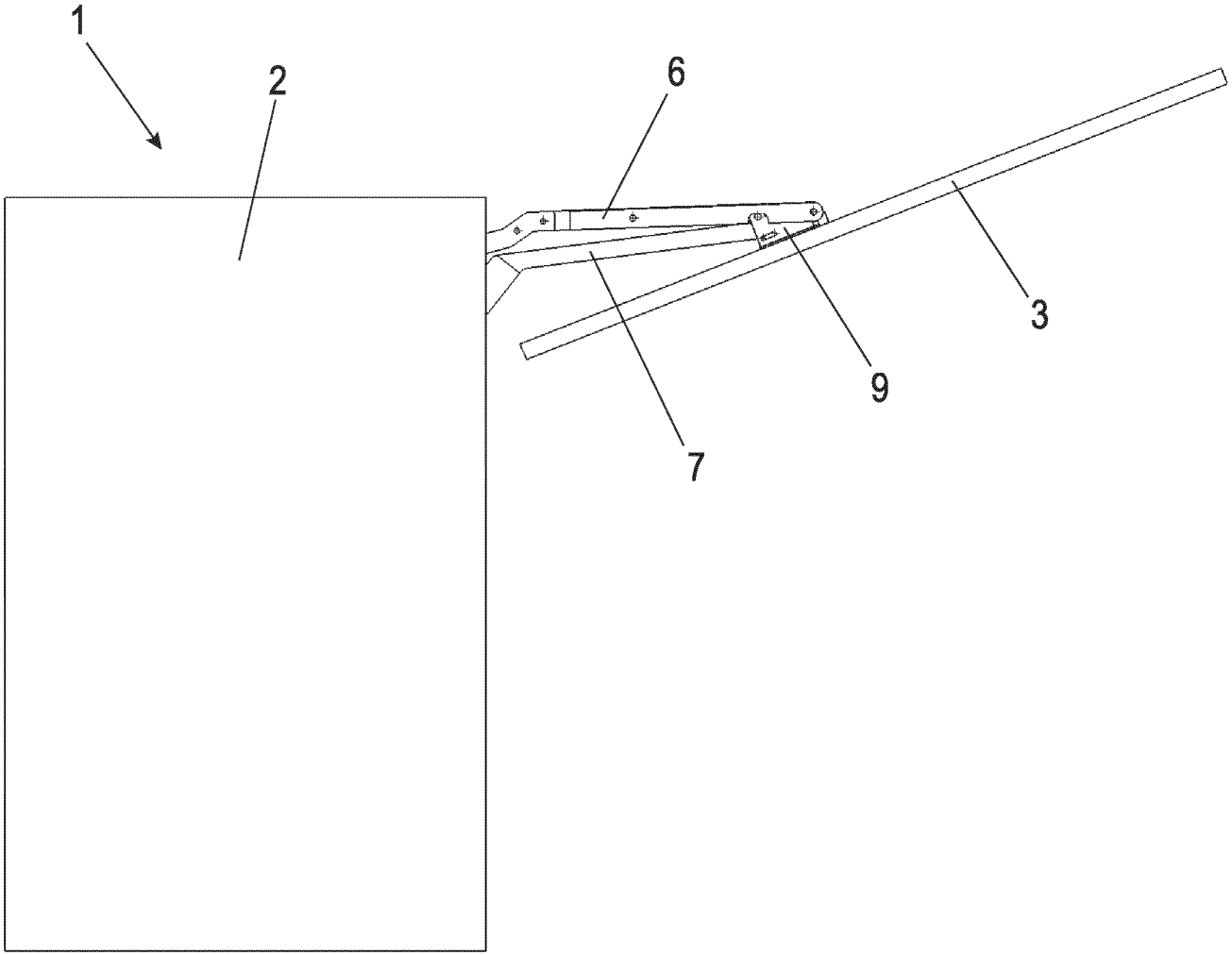

In FIGS. 3A and 3B, flap 3 is shown in an opening position. Flap 3 has been pivoted forwards away from furniture body 2 with an upper section, while a lower section of flap 3, on which a handle element (not shown) is mounted, has been pivoted essentially vertically upwards. In this respect, the user only has to perform a small horizontal movement and essentially a vertical movement when opening and closing flap 3.

In addition to the opening movement shown, other opening movements, such as those known in the prior art, can also be realized for flap 3. These opening movements include, for example, simple tilting up or folding up the flap 3.

Figure 4A:
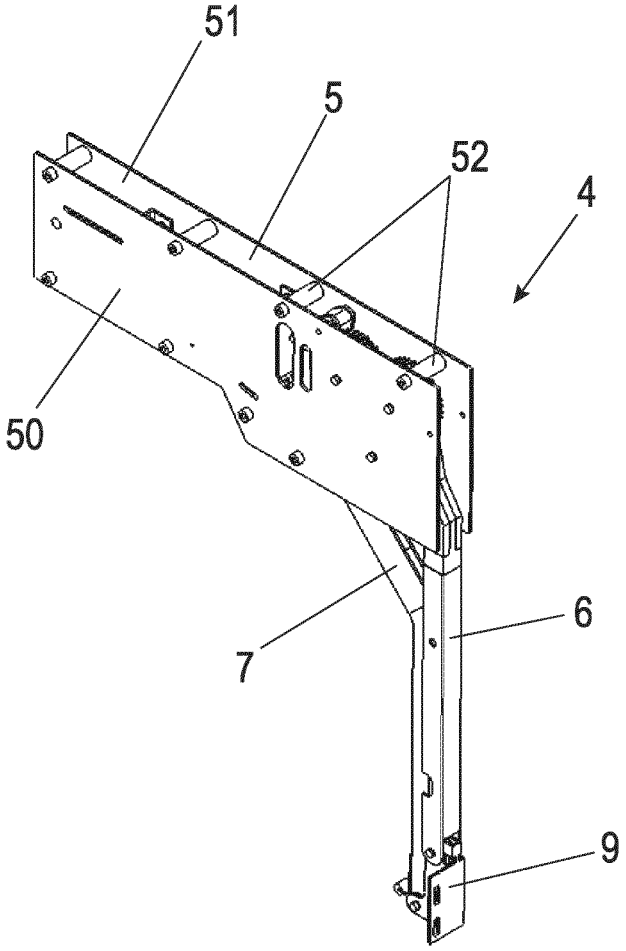
FIGS. 4A and 4B show two views of the pivot fitting in a closed position.
Figure 4B:
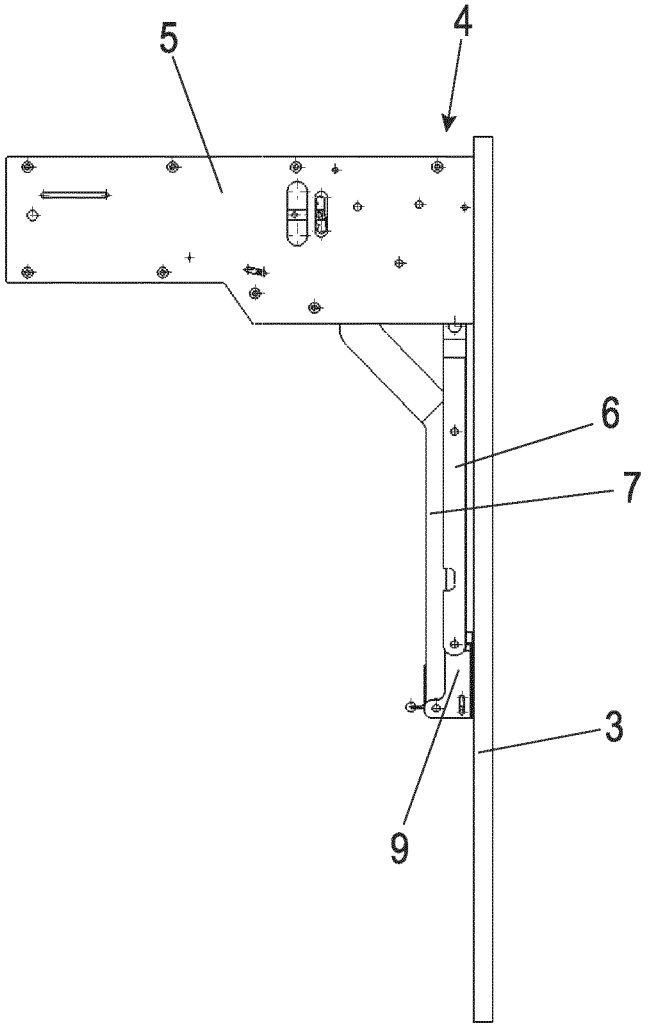

In FIGS. 4A and 4B, the flap fitting 4 is shown in a closing position. The support lever 6 and the control lever 7 are arranged partly parallel to each other and extend essentially in vertical direction up to the connection 9, which is mounted on the flap 3.

Figure 5:
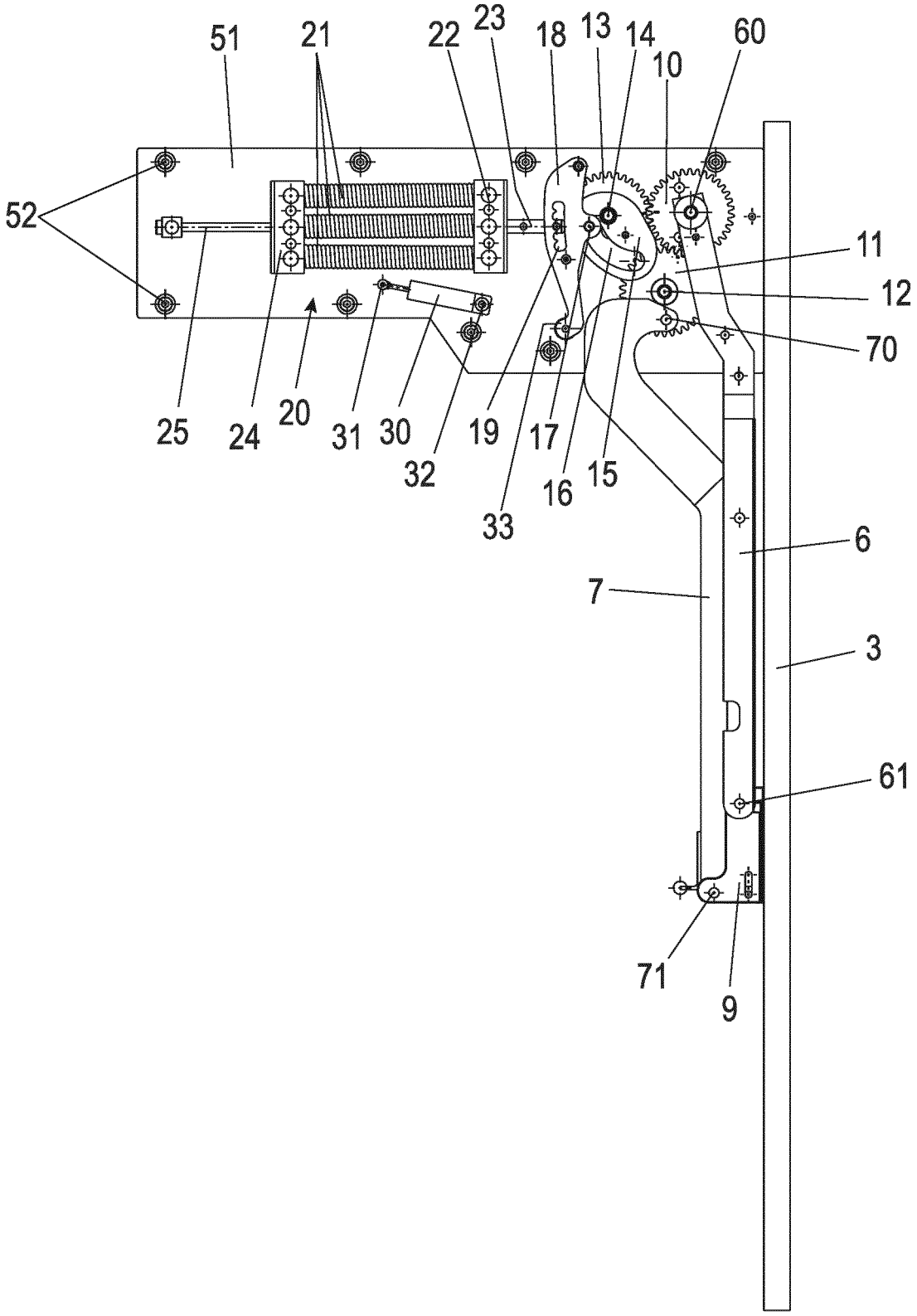
FIG. 5 shows a view of the pivot fitting with the housing partially removed in a closed position.

FIG. 5 shows the flap fitting 4 in a closing position without the side wall 50 of the housing. The support lever 6 is mounted in an articulated manner at one end about a rotary shaft 61 at the connection 9 and at the opposite side about a rotary shaft 60, which is provided on the housing 5. Around the rotary shaft 60, a first gearwheel 10 is connected to the support lever 6 in a rotationally fixed manner, which meshes with a second gearwheel 11, which is mounted on the housing 5 so that it can rotate around a rotary shaft 12.

On the second gearwheel 11, at a distance from the rotary shaft 12 of gearwheel 11, a rotary shaft 70 is provided, on which the control lever 7 is rotatably mounted. The control lever 7 is mounted at the opposite end so that it can rotate about a rotary shaft 71 at the connection 9. The rotary shaft 70 thus moves during an opening and closing process of flap 3, which is held at connection 9.

The connection 9 can be formed in a single-part or multi-part manner.

In order to partially compensate the weight forces of the flap 3 during opening and closing, an energy accumulator 20 is provided, which comprises three springs 21, in particular tension springs in the illustrated embodiment example, which are arranged between a first spring holder 22 and a second spring holder 24. The second spring holder 24 is fixed to the housing 5 by a fastening 25. The spring holder 22 is connected via a rod 23 to a movable holder 18. A receptacle 19 is provided on the holder 18 to which the rod 23 of the energy accumulator 20 is fixed so that the holder 18 is pretensioned by the energy accumulator 20. The holder 18 has a guide element 17 mounted in a curve guide 16 of a control disc 15. The control disc 15 is mounted so that it can rotate about a rotary shaft 14, which is provided on the housing 5. In addition, the control disc 15 is coupled in a rotationally fixed manner to a third gearwheel 13, which meshes with the first gearwheel 10. Various positioning options for positioning the rod 23 of the energy accumulator 20 are provided on the receptacle 19 of the holder 18, so that an optimum pre-adjustment of the spring effect to the weight forces of the flap 3 to be compensated can already be made by selecting a suitable position. Instead of the positioning options, an infinitely variable presetting can also be provided, for example in the form of a screw/nut connection, which can be used to change the position of the rod 23 to the holder 18.

The term "gearwheel" refers to rotating discs with an external toothing, wherein the external toothing extends either over the entire circumference or only a part of the circumference. Alternatively, tooth segments, internal gears or other components can also be used as gearwheels on which teeth are provided for positive engagement with an adjacent gearwheel.

A damper 30, which is designed as a linear damper, in particular as a fluid, liquid or air damper, is also provided on the housing 5, which is held on a fastening element 31 on the housing 5 and comprises a piston-cylinder unit that generates damping forces when compressed. A contact surface 32 is provided on the side facing away from the fastening element 31, for example a contact roller that can be contacted by an actuating element 33 on the holder 18.

Figure 6:
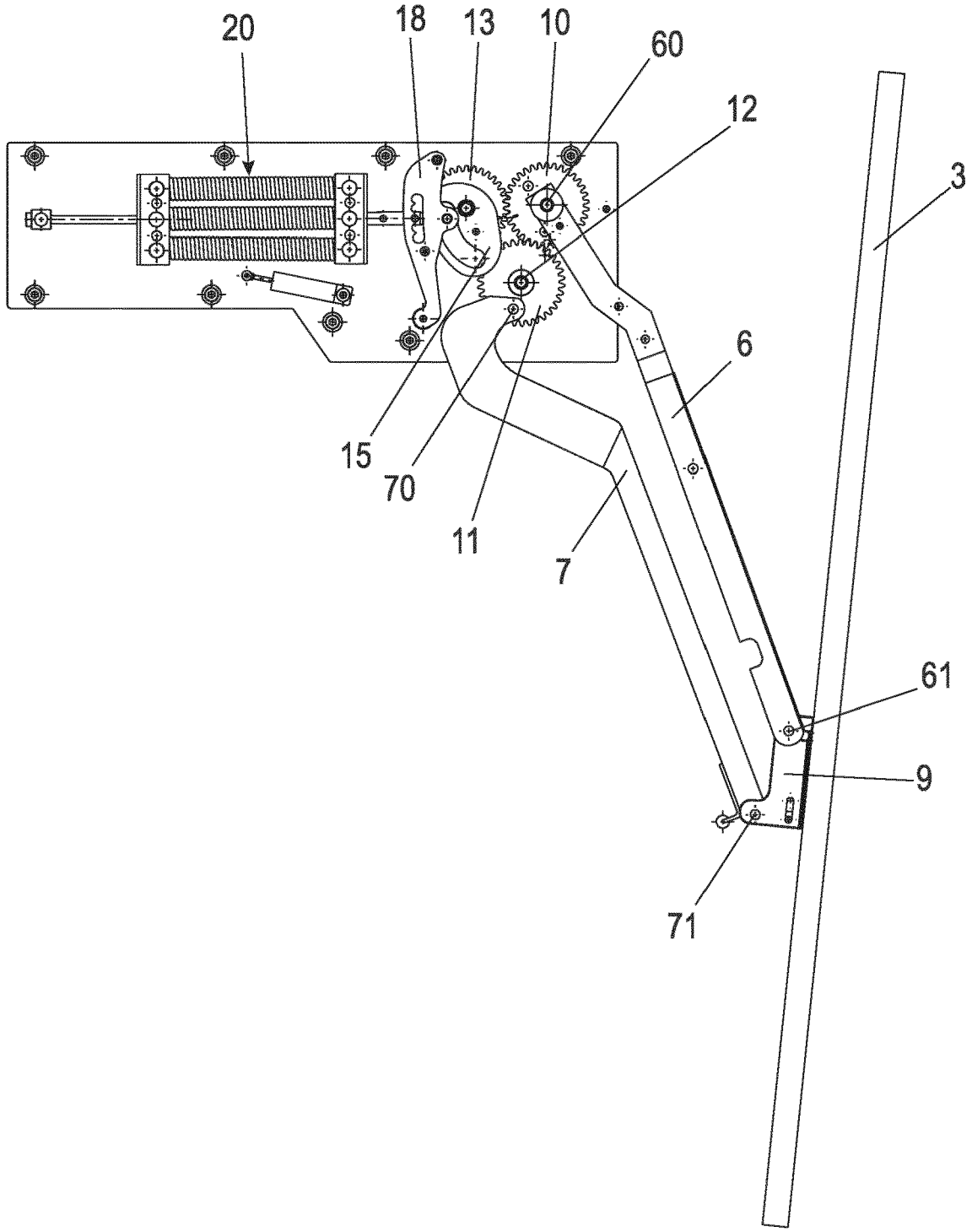
FIGS. 6 to 8 show several views of the flap fitting of the figure in different positions.

For an opening operation, a handle located in the lower area of flap 3 is operated by a user to move flap 3 forward and upwards. FIG. 6 shows flap 3 in a slightly open position. The energy accumulator 20 is further tensioned at the beginning of the opening movement, since the flap 3 is pretensioned in the closing direction in the area of the closing position. After overcoming a dead center, the energy accumulator 20 supports the movement of flap 3 in the opening direction.

Figure 7:
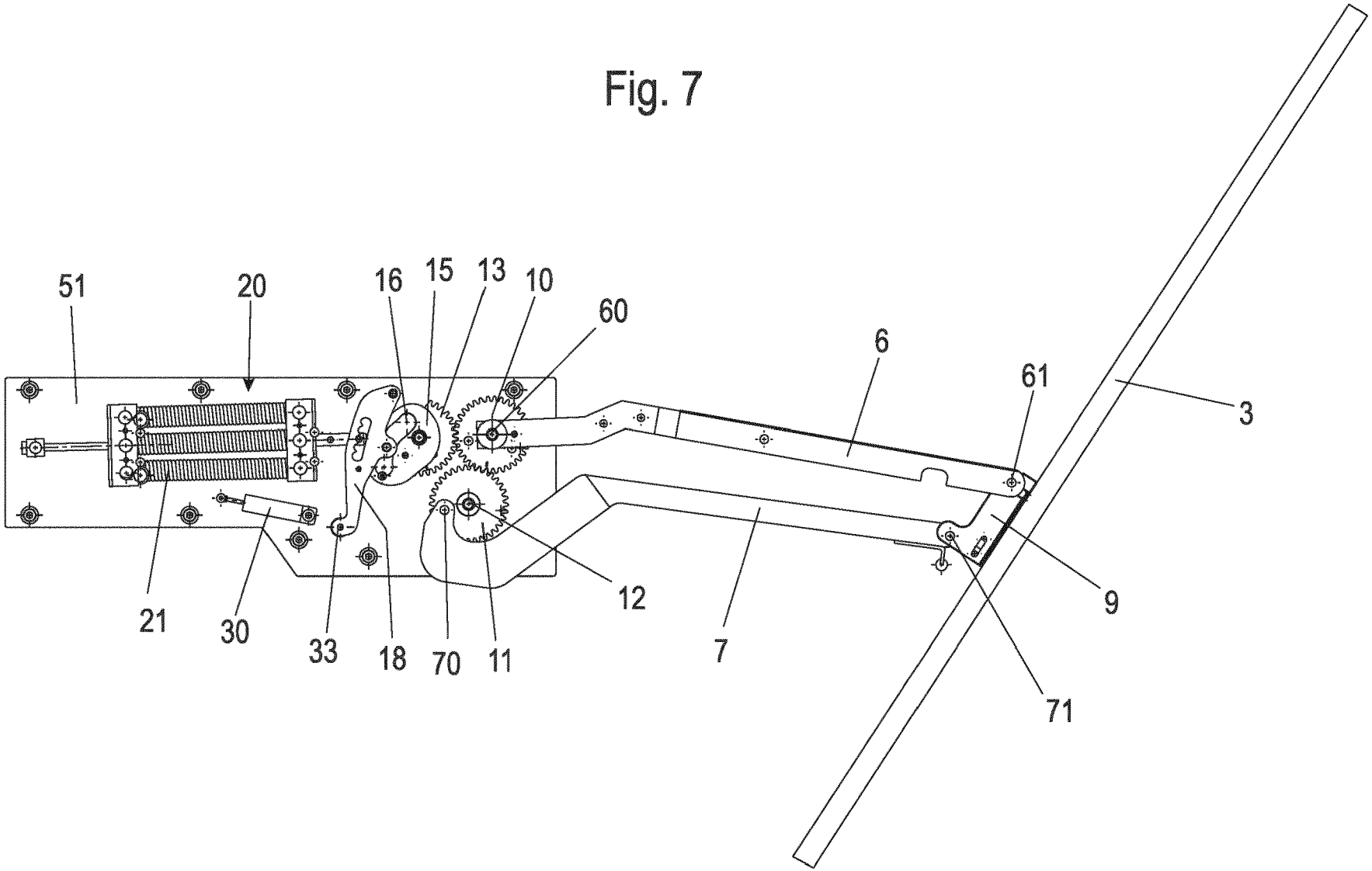

If the flap 3 is moved further in the opening direction as shown in FIG. 7, both the support lever 6 pivot about the rotary shaft 60 and the control lever 7 pivot about the rotary shaft 70, which is arranged on the rotatable gearwheel 11. From the closing position (FIG. 5) to the position in FIG. 7, the gearwheel 11 was rotated about 90°, so that the rotary shaft 70 has also shifted. The gearwheels 10 and 11 are in mesh, so that the two support levers 6 and the control lever 7 are coupled to each other both in the area of the housing 5 and at the connection 9. The rotation of gearwheel 10 also drives the third gearwheel 13, which rotates the control disc 15. By turning the control disc 15 the curve guide 16 is moved, which enables the springs 21 of the energy accumulator 20 to contract when the dead center is exceeded during an opening movement, so that the energy accumulator 20 supports the opening process.

Figure 8:
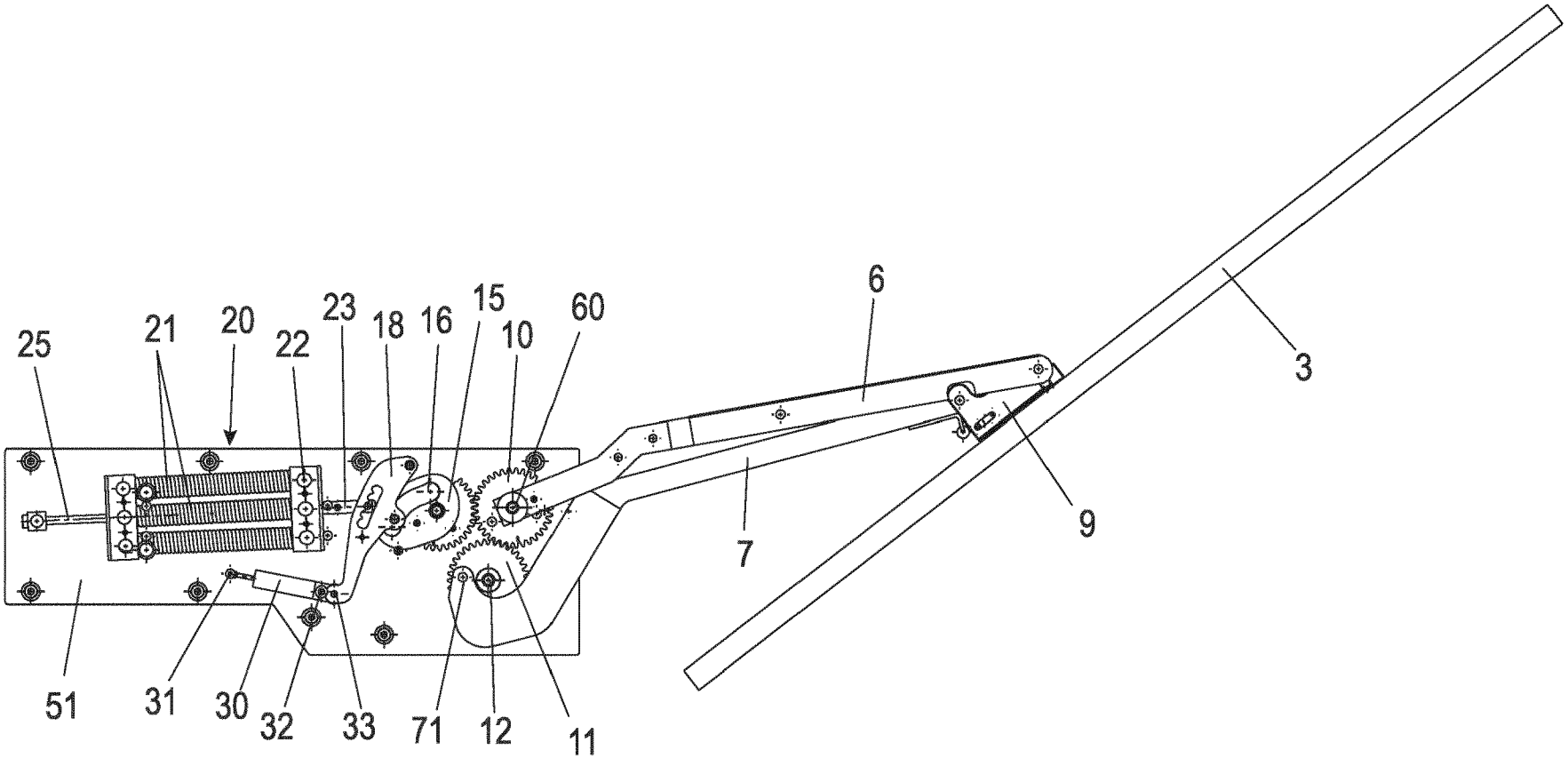

Flap 3 is moved further in the opening direction as shown in FIG. 8, with an upper end of flap 3 protruding forwards and upwards. A lower part of the flap essentially moves vertically upwards just before the opening at the furniture body 2.

Figure 9:
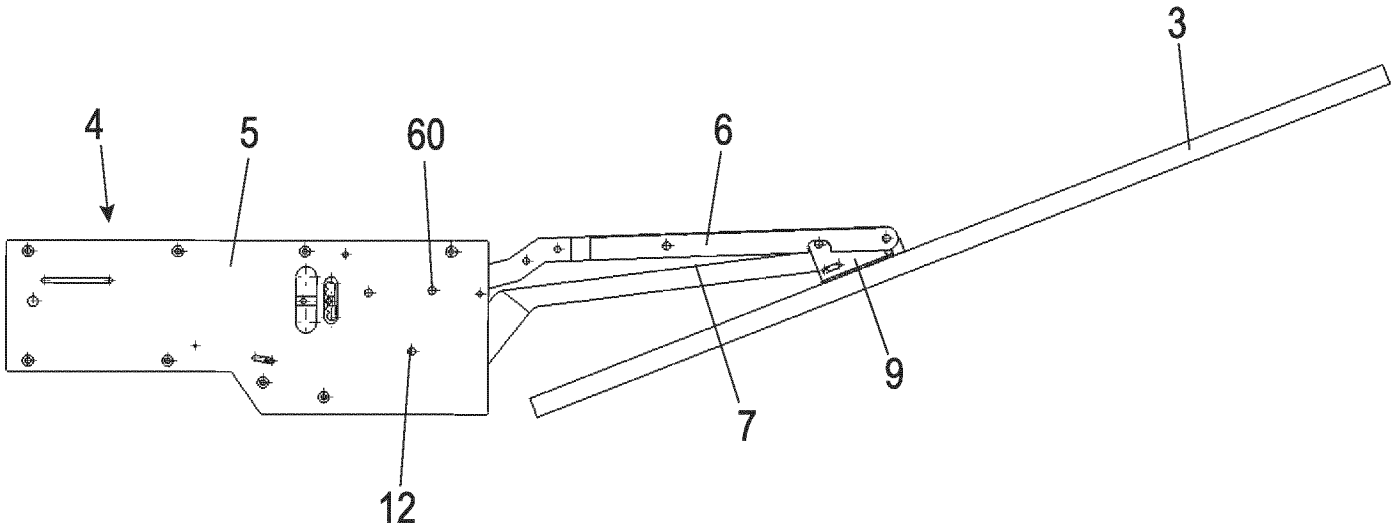
FIG. 9 shows a view of the flap fitting in an open position.

FIG. 9 shows the maximum opening position of the flap fitting 4. The flap 3 is slightly inclined to the horizontal, for example in a range between 10° and 20°, and largely opens up the opening area on the furniture body 2. Before reaching the maximum opening position, the opening movement can be slowed down, for example by a damper located in connection 9. Alternatively, or additionally, the damper 30 is provided in the housing 5, which is compressed by the actuating element 33 on the holder 18, as shown in FIG. 8.

For a closing movement, the user pulls the flap 3 downwards against the force of the energy accumulator 20 until the flap 3 is again in the closing position shown in FIG. 5.

In the embodiment example shown, three gearwheels 10, 11 and 13 are arranged in the housing 5. It is also possible to provide a gear unit with a predetermined transmission ratio in the housing 5 in order to adapt the tensioning and unloading of the energy accumulator 20 even more to the weight of the flap 3 and other parameters.

Figure 10A:
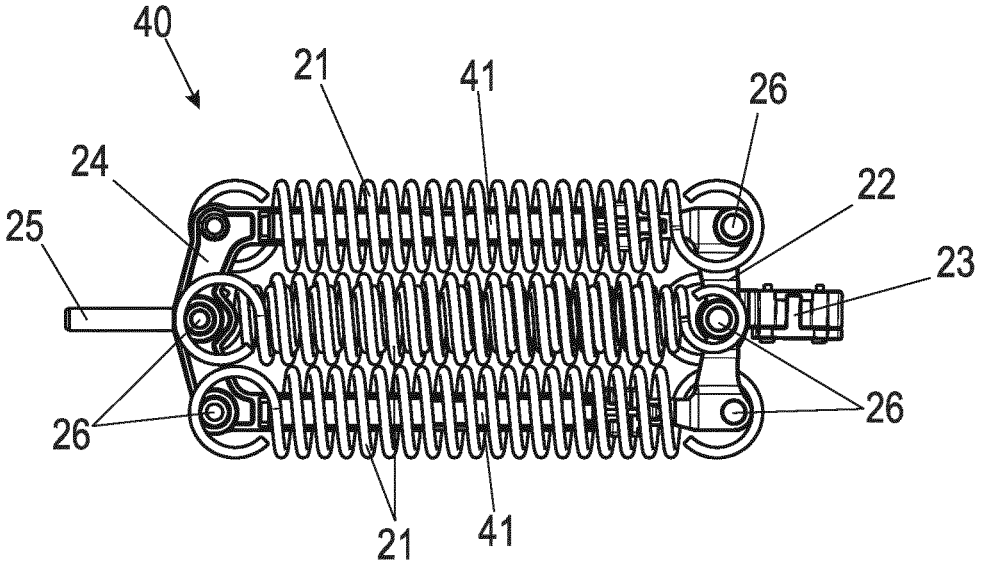
FIGS. 10A and 10B show two views of a damper assembly according to the invention for the flap fitting in different positions.
Figure 10B:
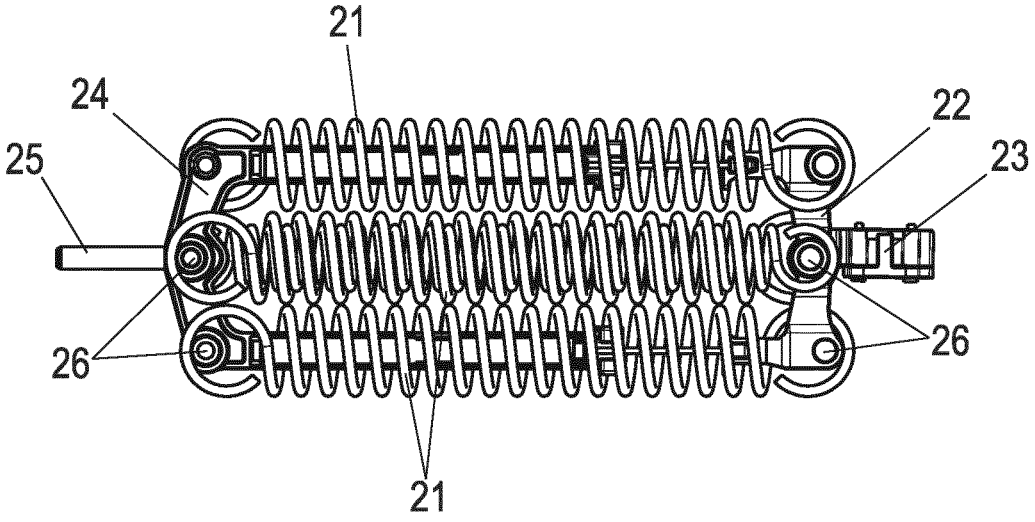

In FIGS. 10A and 10B a damper assembly 40 is shown, as shown schematically in FIGS. 5 to 8. The damper assembly 40 comprises three springs 21, which are designed as coil springs and are tensioned between the first spring holder 22 and the second spring holder 24. The springs 21 are designed as tension springs and have an eye at the end which is attached to the spring holders 22 and 24 on pin 26. Other mechanisms for fastening the springs 21 can also be used. It is also possible to use compression springs instead of tension springs. The two spring holders 22 and 24 are formed in a bow-shaped manner, wherein the first spring holder 22 is provided with a rod 23 or a joint for connection to the actuating mechanism. On the second spring holder 24 there is a fastening 25 for fixing to the housing 5.

The design of the flap fitting 4 is only to be understood as an example. Instead of the four-joint arrangement formed by the support lever 6 and the control lever 7, a seven-joint arrangement can also be formed by the support lever 6 and the control lever 7 and further levers. In a seven-joint arrangement, the support lever 6 and the control lever 7 are thus connected to the flap 3 via the other levers. The rotary shafts of the support lever 6 and the control lever 7 can also be fixed to the base body 5, so that the rotary shaft 70 does not perform any relative movement to the base body 5 during the flap movement. This means that the force transmission from joint arrangement 6, 7 to damper assembly 40 may be formed differently.

The damper assembly 40 comprises, in each of the two outer springs 21, a damper designed as a linear damper and comprises a damper housing 41 and a piston rod 42. In the middle spring 21 another coil spring is arranged, so that in the damper assembly in FIGS. 10A and 10B four springs are actuated when the spring holders 22 and 24 move. It is also possible to use only two or three springs 21 for the damper assembly 40, or more than four springs.

Figure 11A:
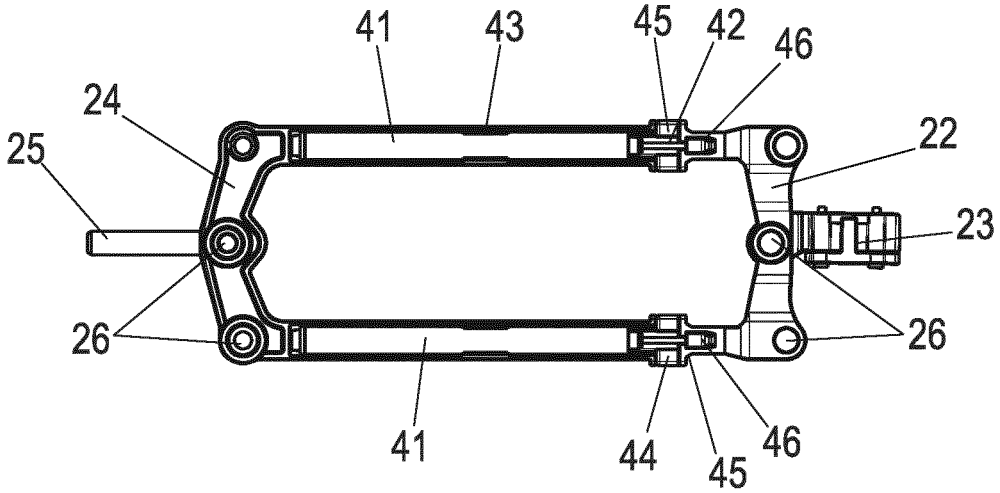
FIGS. 11A and 11B show two views of the damper assembly of FIG. 10 without springs.
Figure 11B:
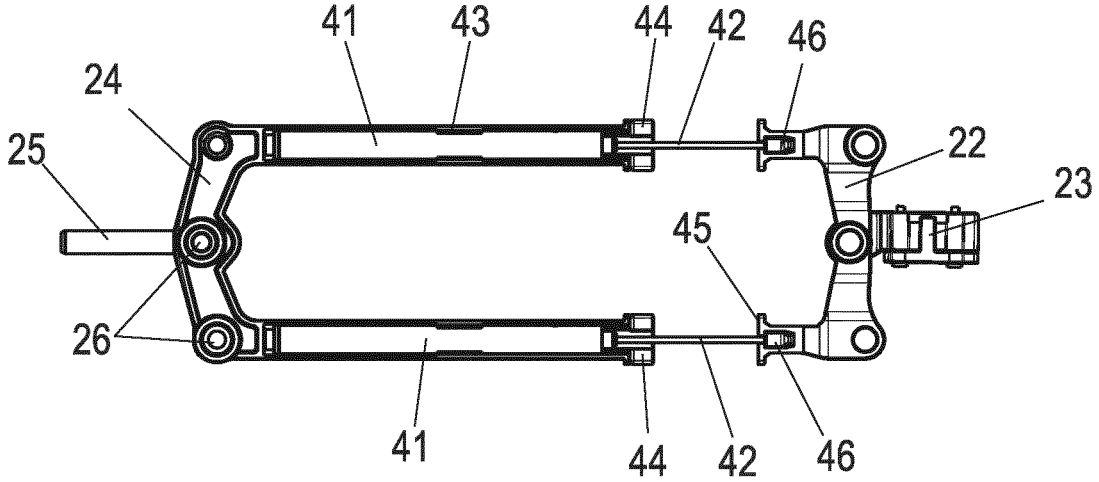

In FIGS. 11A and 11B, the damper assembly of FIG. 10 is shown without springs 21. The spring holder 24 is equipped with a sleeve-shaped receptacle 43, into which a cylindrical damper housing 41 is inserted and fixed in a clamping or latching manner, for example. An elastic stop 44 is arranged at the end of the receptacle 43, for example made of rubber or an elastomer, which avoids loud stop noises between the receptacle 43 and the spring holder 22. At the ends of the spring holder 22, which face the receptacles 43, stops 45 are designed for this purpose. A linearly displaceable piston rod 42 protrudes from each damper housing 41, which has a thickened head section 46 at the end, which is fixed to the spring holder 22 in a receptacle. When the spring holders 22 and 24 move relative to each other, the dampers are thus actuated, wherein the dampers are designed as pressure dampers and generate damping forces when the piston rod 42 is pushed into the damper housing 41, while the piston rod 42 is pulled out smoothly. It is also possible to use rebound dampers instead of compression dampers. The linear dampers preferably comprise a damping fluid such as oil, especially silicone oil.

The elastic stop 44 is fixed at the end of the receptacle 43. It is obviously also possible to place the stop 44 at one end of the bow-shaped spring holder 22 adjacent to the head section 46.

Figure 12:
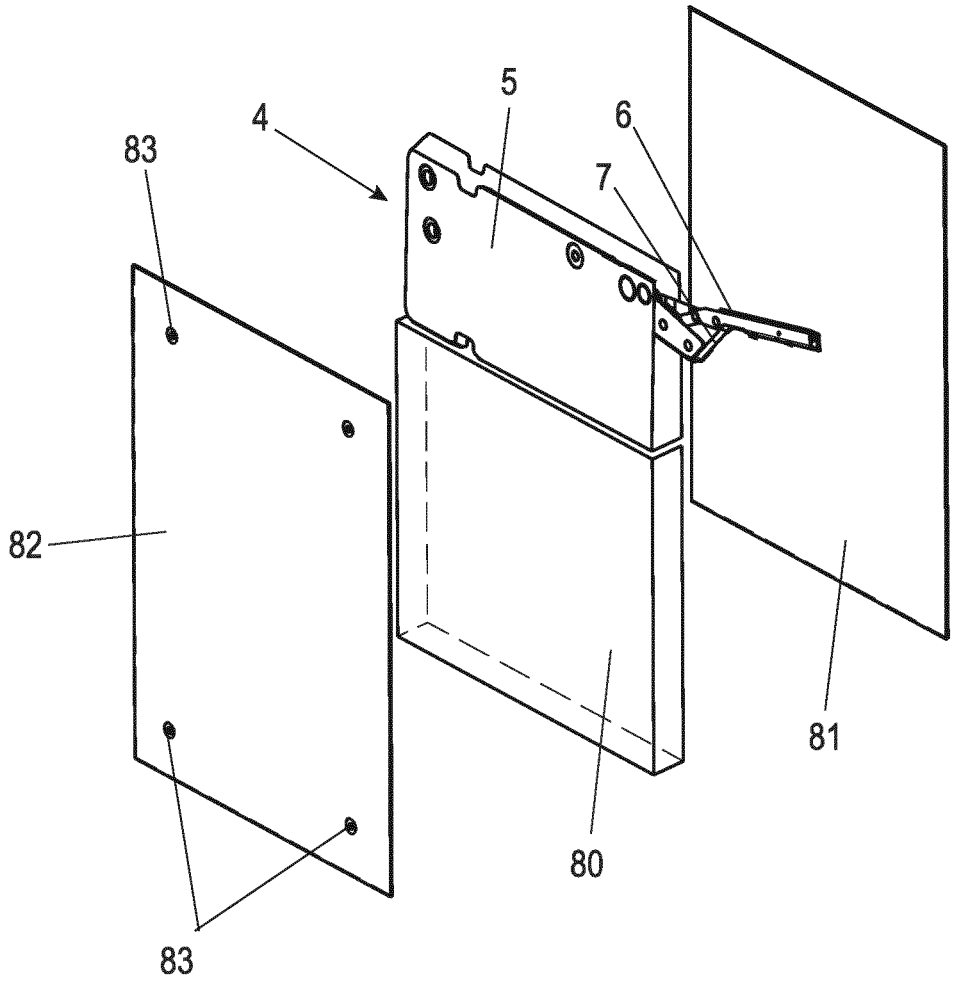
FIG. 12 shows a view of a modified flap fitting arranged in a side wall of an item of furniture.

In FIGS. 1 to 9, a flap fitting 4 is attached in each case to the inside of one side wall of a furniture body 2. In FIG. 12, the flap fitting 4 is not integrated on an inside but in a side wall of the furniture body 2. For this purpose, the side wall comprises a plate-shaped core material 80, for example of a wood-based material, on which the housing 5 of the flap fitting 4 is arranged adjacent, either over the entire width of the core material 80 or at a recess of the core material 80 which extends over only part of the width of the core material 80. The housing 5 and the core material 80 are covered on the outside by an outer layer 81 and on the inside by an inner layer 82, wherein the outer layer 81 and inner layer 82 can optionally be identical in construction, for example made of a foil or a decorative layer. In the embodiment example shown, the inner layer 82 is fixed to the core material 80 and the housing 5 via fixing points. The housing 5 can be glued to the core material 5 or connected to fastening means. Due to the arrangement of the housing in the side wall of a furniture body, the housing is only visible from one face end when the flap 3 is open, when the support lever 6 and the control lever 7 protrude to the front.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Furniture
2 Furniture body
3 Flap
4 Flap fitting
5 Housing
6 Support lever
7 Control lever
8 Rod
9 Connection
10 Gearwheel
11 Gearwheel
12 Rotary shaft
13 Gearwheel
14 Rotary shaft
15 Control disc
16 Curve guide
17 Guide element
18 Holder
19 Receptacle
20 Energy accumulator
21 Spring
22 Spring holder
23 Rod
24 Spring holder
25 Fastening
26 Pin
30 Damper
31 Fastening element

32 Contact surface
33 Actuating element
40 Damper assembly
41 Damper housing
42 Piston rod
43 Receptacle
44 Stop
45 Stop
46 Head section
50 Side wall
51 Side wall
52 Spacer
60 Rotary shaft
61 Rotary shaft
70 Rotary shaft
71 Rotary shaft
80 Core material
81 Outer layer
82 Inner layer
83 Fastening points

The invention claimed is:

1. A flap fitting for furniture, the flap fitting comprising:
a base body;
a support lever is rotatably mounted on the base body; and
a control lever pivotably mounted on the base body, wherein the support lever and the control lever are connectable via spaced rotary shafts in an articulated manner to a flap of the furniture or are connectable to a flap of the furniture via further levers;
an energy accumulator, having at least two coil springs, that pretensions the flap of the furniture at least over part of a range of movement of the flap of the furniture; and
a damper assembly arranged on or in the base body, wherein the damper assembly comprises
a first spring holder;
a second spring holder;
said at least two coil springs arranged between the first and second spring holders, wherein in a first one of the at least two coil springs a first linear damper having a damper housing and a piston rod that is displaceable relative to the damper housing is arranged between the first and second spring holders, and wherein n a second one of the at least two co springs second linear damper having a damper housing and a piston rod that is displaceable relative to the damper housing s arranged between the first and second spring holders.

2. The flap fitting of claim 1, wherein the first and second spring holders are dimensionally stable brackets.

3. The flap fitting of claim 1, wherein four springs are arranged between the first and second spring holders.

4. The flap fitting of claim 1, wherein the damper assembly is symmetrical to a central plane with regard to an arrangement of the at least two coil springs.

5. The flap fitting of claim 1, further comprising:
a receptacle, that fixes the damper housing, is arranged on the second spring holder, wherein an elastic stop for the first spring holder is arranged at an end of the receptacle.

6. The flap fitting of claim 1, wherein the at least two coils springs are tension springs or compression springs.

7. The flap fitting of claim 1, wherein the first and second spring holders are interconnected by additional damperless linear guide means arranged outside the at least two coil springs.

8. The flap fitting of claim 1, wherein the first and second spring holders are interconnected by additional damperless linear guide means arranged within at least one of the at least two springs.

9. The flap fitting of claim 1, wherein the damper housing has different regions with different diameters in a piston working chamber.

10. The flap fitting of claim 1, wherein the damper assembly brakes a closing movement of the flap of the furniture before reaching a closing position of the flap of the furniture.

11. The flap fitting of claim 1, wherein the energy accumulator pretensions the flap of the furniture in a closing direction in a closed position and pretensions the flap of the furniture in an opening direction in an opening region.

12. The flap fitting of claim 1, wherein the first spring holder is coupled to the control lever via a curve guide.

13. The flap fitting of claim 12, further comprising:
a gear unit that is driven by the control lever and that actuates the curve guide.

14. The flap fitting of claim 13, wherein the gear unit has at least one gearwheel or a lever arm.

* * * * *